US012280979B2

(12) United States Patent
Murata et al.

(10) Patent No.: US 12,280,979 B2
(45) Date of Patent: Apr. 22, 2025

(54) SHEET POST-PROCESSING DEVICE

(71) Applicant: KYOCERA Document Solutions Inc., Osaka (JP)

(72) Inventors: Koji Murata, Osaka (JP); Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 53 days.

(21) Appl. No.: 18/463,772

(22) Filed: Sep. 8, 2023

(65) Prior Publication Data

US 2024/0101385 A1 Mar. 28, 2024

(30) Foreign Application Priority Data

Sep. 16, 2022 (JP) ..... 2022-148422

(51) Int. Cl.
*B65H 45/20* (2006.01)
*B65H 31/02* (2006.01)
*B65H 45/04* (2006.01)

(52) U.S. Cl.
CPC ..... *B65H 45/04* (2013.01); *B65H 31/02* (2013.01); *B65H 2801/27* (2013.01)

(58) Field of Classification Search
CPC ..... B65H 45/04; B65H 45/20; B65H 45/101; B65H 45/14; B65H 31/02; B65H 31/26; B65H 2801/27; B65H 2701/18272; B65H 2403/945; B65H 2405/11151; B65H 2404/691; B65H 2402/31
USPC ..... 270/39.01, 39.05
See application file for complete search history.

(56) References Cited

U.S. PATENT DOCUMENTS 5,419,545 A * 5/1995 Hutson ..... B65H 29/14 271/220
7,607,659 B2 * 10/2009 Fukatsu ..... B65H 31/34 271/220
7,624,975 B2 * 12/2009 Reeves ..... B65H 31/26 270/58.12
8,485,523 B2 * 7/2013 Kimura ..... B65H 33/08 271/220
9,340,390 B2 * 5/2016 Ishikawa ..... B65H 31/08
2015/0105231 A1 4/2015 Ishikawa et al.

FOREIGN PATENT DOCUMENTS

JP 2015-78031 A 4/2015

* cited by examiner

*Primary Examiner* — Leslie A Nicholson, III
(74) *Attorney, Agent, or Firm* — Stein IP, LLC

(57) ABSTRACT

A sheet post-processing device includes a discharge port, a discharge tray, and a sheet holding member. On the discharge tray, a sheet discharged through the discharge port is stacked. The sheet holding member is swingably attached above the discharge port, and holds the sheet stacked on the discharge tray. The sheet holding member has a plurality of link members and a joint portion. The plurality of link members are coupled to each other along a discharge direction of the sheet. The joint portion couples the plurality of link members to each other. The sheet holding member is capable of changing a shape thereof by being bent at the joint portion in an up-down direction.

2 Claims, 8 Drawing Sheets

SHEET POST-PROCESSING DEVICE

INCORPORATION BY REFERENCE

This application is based on and claims the benefit of priority from Japanese Patent Application No. 2022-148422 filed on Sep. 16, 2022, the contents of which are hereby incorporated by reference.

BACKGROUND

The present disclosure relates to a sheet post-processing device that performs post-processing with respect to a sheet having had an image formed thereon by an image forming apparatus.

A known sheet post-processing device performs folding processing of forming a fold in a sheet having had an image formed thereon by an image forming apparatus such as a copier, a printer, or the like. In a case where sheets subjected to such folding processing are discharged to be stacked on a discharge tray, the folded-parts of the sheets make the stack of the sheets partly thick, and thus it is difficult to stack a large number of such sheets in an aligned manner. Measures have conventionally been taken to deal with this inconvenience.

SUMMARY

According to one aspect of the present disclosure, a sheet post-processing device includes a discharge port, a discharge tray, and a sheet holding member. The discharge port has a pair of discharge rollers that discharge a sheet including a folded sheet subjected to folding processing. On the discharge tray, the sheet discharged through the discharge port is stacked. The sheet holding member is swingably attached above the pair of discharge rollers to extend toward the discharge tray, and holds the sheet stacked on the discharge tray. The sheet holding member has a plurality of link members and a joint portion. The plurality of link members are coupled to each other along a discharge direction of the sheet. The joint portion couples the plurality of link members to each other. The sheet holding member is capable of changing a shape thereof by being bent at the joint portion in an up-down direction.

DETAILED DESCRIPTION

Embodiments of the present disclosure will be described below with reference to the accompanying drawings. It should be understood, however, that the present disclosure is not limited to what is specifically described below.

Figure 1:
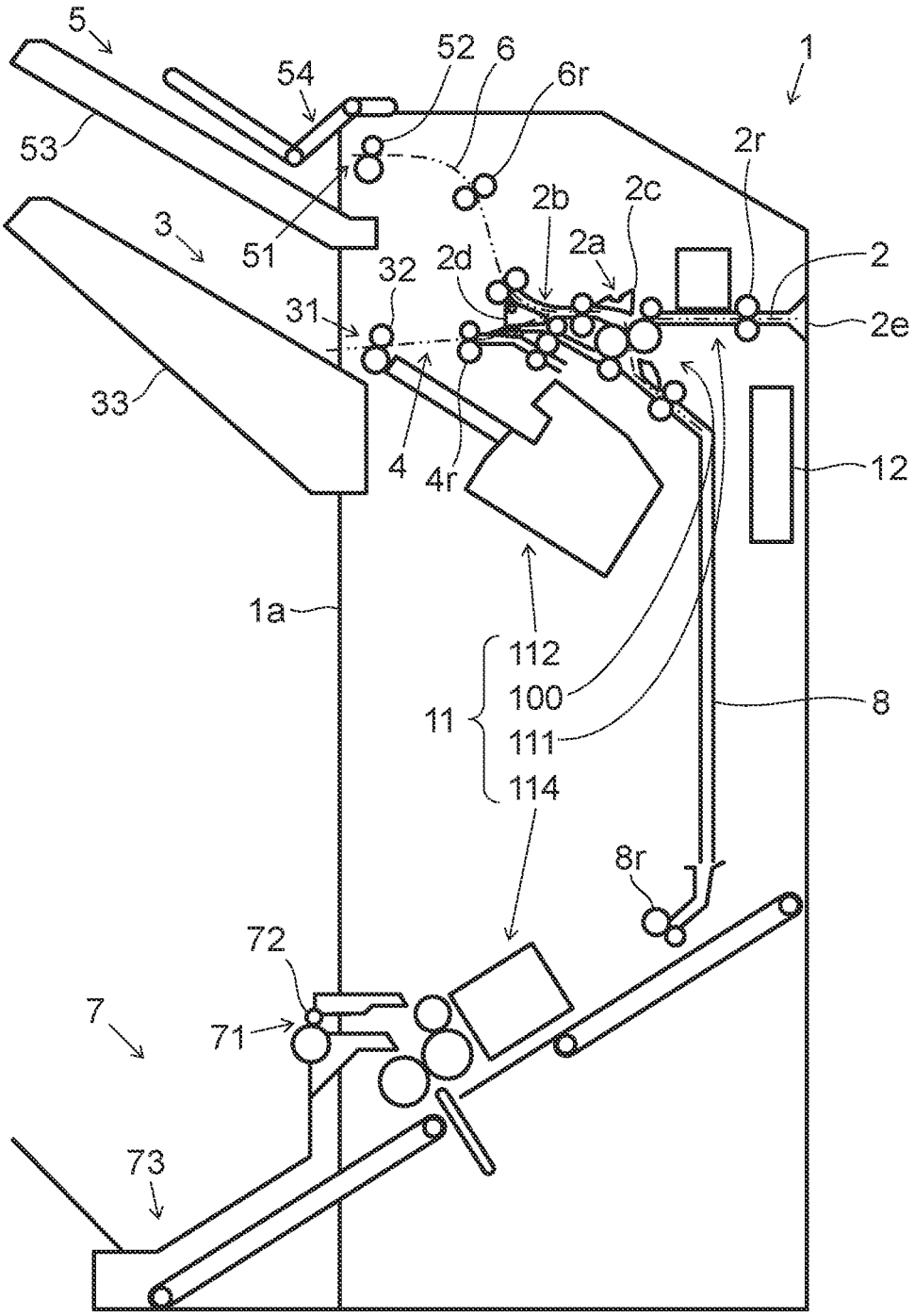
FIG. 1 is a schematic sectional front view of a sheet post-processing device according to one embodiment of the present disclosure.

FIG. 1 is a schematic sectional front view of a sheet post-processing device 1 according to one embodiment. The sheet post-processing device 1 is attachably/detachably coupled to a side face of, for example, an image forming apparatus (unillustrated). The sheet post-processing device 1 performs post-processing with respect to a sheet having had an image formed (printed) thereon by the image forming apparatus.

As shown in FIG. 1, the sheet post-processing device 1 includes a sheet introduction path 2, a first sheet discharge portion 3, a first sheet discharge path 4, a second sheet discharge portion 5, a second sheet discharge path 6, a third sheet discharge portion 7, a third sheet discharge path 8, a post-processing portion 11, and a post-processing control portion 12.

The sheet introduction path 2 has a sheet introduction port 2*e*. The sheet introduction port 2*e* is provided in a side face of the sheet post-processing device 1, the side face facing the image forming apparatus (not shown). A sheet conveyed from the image forming apparatus toward the sheet post-processing device 1 passes through the sheet introduction port 2*e* and the sheet introduction path 2 to be introduced into the sheet post-processing device 1.

The sheet introduction path 2 substantially horizontally extends from the sheet introduction port 2*e* to a sheet folding portion 100, which will be described later, in a direction (a leftward direction in FIG. 1) away from the image forming apparatus. In this description, a direction from the sheet introduction port 2*e* toward an inside of the sheet post-processing device 1 is referred to as a sheet conveyance direction along the sheet introduction path 2. The sheet introduction port 2*e* is located at an upstream end of the sheet introduction path 2 in the sheet conveyance direction. In the sheet introduction path 2, pairs of feed rollers 2*r* are disposed. The pairs of feed rollers 2*r* convey, on the sheet introduction path 2, a sheet introduced through the sheet introduction port 2*e* into the sheet post-processing device 1, toward a downstream side in the sheet conveyance direction.

The sheet introduction path 2 has a first branching portion 2*a* and a second branching portion 2*b*. The first branching portion 2*a* is located upstream of the second branching portion 2*b* with respect to the sheet conveyance direction along the sheet introduction path 2. The second branching portion 2*b* is located at a downstream end part of the sheet introduction path 2 in the sheet conveyance direction.

At the first branching portion 2*a*, a first switching guide 2*c* is disposed. The first switching guide 2*c* switches a conveyance direction of a sheet conveyed on the sheet introduction path 2 from a side of the sheet introduction port 2*e* toward the downstream side in the sheet conveyance direction between a direction leading to the first sheet discharge portion 3 and the second sheet discharge portion 5 and a direction leading to the third sheet discharge portion 7.

At the second branching portion 2*b*, a second switching guide 2*d* is disposed. The second switching guide 2*d* switches the conveyance direction of the sheet conveyed on the sheet introduction path 2 from the side of the sheet introduction port 2*e* toward the downstream side in the sheet conveyance direction between a direction leading to the first sheet discharge portion 3 and a direction leading to the second sheet discharge portion 5.

The first sheet discharge portion 3 is provided on a side face 1*a* of the sheet post-processing device 1, the side face 1*a* being located opposite the side face of the sheet post-processing device 1 that faces the image forming apparatus. The first sheet discharge portion 3 has a first discharge port 31, a pair of first discharge rollers 32, and a first discharge tray 33.

The first discharge port 31 is located at a downstream end of the first sheet discharge path 4 in the sheet conveyance direction. The pair of first discharge rollers 32 are disposed at the first discharge port 31. The first discharge tray 33 is located downstream of the first discharge port 31 in the sheet conveyance direction. A sheet having been conveyed along the first sheet discharge path 4 to reach the first discharge port 31 is discharged, by the pair of first discharge rollers 32, through the first discharge port 31 onto the first discharge tray 33. The first discharge tray 33 is one of final discharge destinations of sheets subjected to the post-processing performed by the sheet post-processing device 1.

The first sheet discharge path 4 is continuous with the downstream end of the sheet introduction path 2 in the sheet conveyance direction, and substantially horizontally extends to the first sheet discharge portion 3 in the direction (the leftward direction in FIG. 1) away from the image forming apparatus. In this description, a direction (the leftward direction in FIG. 1) from the inside of the sheet post-processing device 1 toward the first discharge portion 3 is referred to as a sheet conveyance direction along the first sheet discharge path 4. In the first sheet discharge path 4, pairs of feed rollers 4*r* are disposed. The pairs of feed rollers 4*r* convey a sheet having passed through the sheet introduction path 2 to reach the second branching portion 2 toward a downstream side on the first sheet discharge path 4 in the sheet conveyance direction, that is, toward the first sheet discharge portion 3.

The second sheet discharge portion 5 is provided on the side face 1*a* of the sheet post-processing device 1 located opposite the side face thereof facing the image forming apparatus, above the first sheet discharge portion 3. The second sheet discharge portion 5 has a second discharge port (a discharge port) 51, a pair of second discharge rollers (a pair of discharge rollers) 52, and a second discharge tray (a discharge tray) 53.

The second discharge port 51 is located at a downstream end of the second sheet discharge path 6 in the sheet conveyance direction. The pair of second discharge rollers 52 are disposed at the second discharge port 51. The second discharge tray 53 is located downstream of the second discharge port 51 in the sheet conveyance direction. A sheet having been conveyed through the second sheet discharge path 6 to reach the second discharge port 51 is discharged, by the pair of second discharge rollers 52, through the second discharge port 51 onto the second discharge tray 53. The second discharge tray 53 is one of the final discharge destinations of sheets subjected to the post-processing performed by the sheet post-processing device 1.

The second sheet discharge path 6 branches off from the second branching portion 2 located at a downstream part of the sheet introduction path 2 in the sheet conveyance direction, and the second sheet discharge path 6 extends not only laterally in the direction (the leftward direction in FIG. 1) away from the image forming apparatus but also in an upward direction to the second sheet discharge portion 5. In this description, a direction (an upper-leftward direction in FIG. 1) from the second branching portion 2*b* toward the second sheet discharge portion 5 is referred to as a sheet conveyance direction along the second sheet discharge path 6. In the second sheet discharge path 6, pairs of feed rollers 6*r* are disposed. The pairs of feed rollers 6*r* convey a sheet having passed through the sheet introduction path 2 to reach the second branching portion 2 toward a downstream side on the second sheet discharge path 6 in the sheet conveyance direction, that is, toward the second sheet discharge portion 5.

The third sheet discharge portion 7 is provided on the side face 1*a* of the sheet post-processing device 1 located opposite the side face thereof facing the image forming apparatus, below the first sheet discharge portion 3. In other words, the third sheet discharge portion 7 is disposed near a bottom portion of the sheet post-processing device 1. The third sheet discharge portion 7 has a third discharge port 71, a pair of third discharge rollers 72, and a third discharge tray 73.

The third discharge port 71 is located at a downstream end of the third sheet discharge path 8 in the sheet conveyance direction. The pair of third discharge rollers 72 are disposed at the third discharge port 71. The third discharge tray 73 is located downstream of the third discharge port 71 in the sheet conveyance direction. A sheet having been conveyed through the third sheet discharge path 8 to reach the third discharge port 71 is discharged, by the pair of third discharge rollers 72, through the third discharge port 71 onto the third discharge tray 73. The third discharge tray 73 is one of the final discharge destinations of sheets subjected to the post-processing performed by the sheet post-processing device 1.

The third sheet discharge path 8 branches off from the first branching portion 2*a* located at the downstream part of the sheet introduction path 2 in the sheet conveyance direction, and extends in a downward direction to the third sheet discharge portion 7. In this description, a direction from the first branching portion 2*a* toward the third sheet discharge portion 7 is referred to as a sheet conveyance direction along the third sheet discharge path 8. In the third sheet discharge path 8, pairs of feed rollers 8*r* are disposed. The pairs of feed rollers 8*r* convey a sheet having passed through the sheet introduction path 2 to reach the first branching portion 1 toward a downstream side on the third sheet discharge path 8 in the sheet conveyance direction, that is, toward the third sheet discharge portion 7.

The post-processing portion 11 performs the predetermined post-processing with respect to a sheet having been subjected to image formation performed by the image forming apparatus and introduced into the sheet post-processing device 1. The post-processing portion 11 includes a punching portion 111, a stapling portion 112, a sheet folding portion 100, and a book-binding portion 114.

The punching portion 111 is disposed in the sheet introduction path 2, closely downstream of the sheet introduction port 2*e*. The punching portion 111 is capable of performing punching processing with respect to a sheet conveyed on the sheet introduction path 2, thereby to form a punch hole in the sheet.

The stapling portion 112 is disposed below the first sheet discharge path 4, in the vicinity of the first sheet discharge portion 3. The stapling portion 112 is capable of performing stapling processing (binding processing) with respect to a bundle of sheets formed by stacking together a plurality of sheets, thereby to bind the bundle of sheets.

The sheet folding portion 100 is disposed, with respect to the sheet conveyance direction along the sheet introduction path 2, downstream of the punching portion 111, upstream of the stapling portion 112. The sheet folding portion 100 is capable of performing folding processing with respect to a single sheet, thereby to make a fold in the single sheet.

Figure 2A:
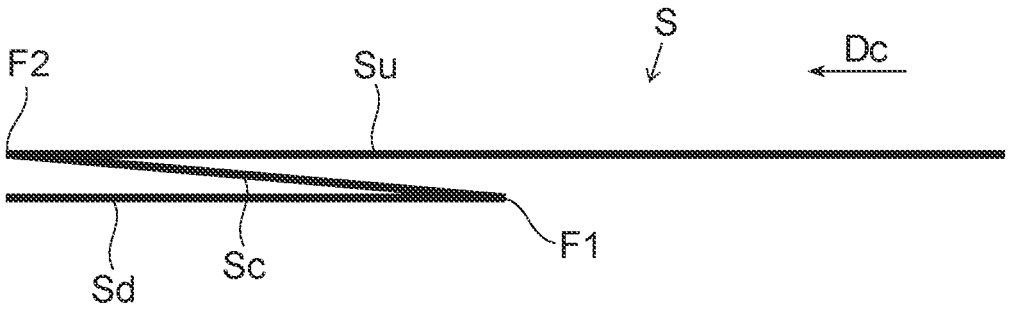
FIG. 2A is a schematic front view of a Z-folded sheet.
Figure 2B:
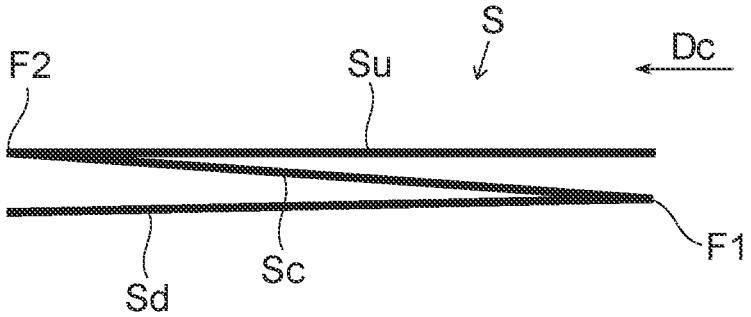
FIG. 2B is a schematic front view of an outward triple-folded sheet.
Figure 2C:
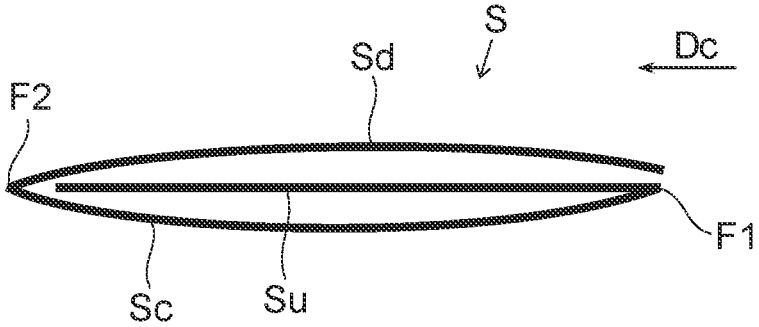
FIG. 2C is a schematic front view of an inward triple-folded sheet.

The sheet folding portion 100 is capable of performing, with respect to a single sheet, processing such as double-folding, Z-folding, outward triple-folding, inward triple-folding, quadruple-folding, etc. FIGS. 2A, 2B, and 2C are schematic front views of a Z-folded sheet S, an outward triple-folded sheet S, and an inward triple-folded sheet S, respectively.

Z-folding is a manner of folding in which, as shown in FIG. 2A for example, a downstream part of a sheet S with respect to the sheet conveyance direction Dc along the sheet introduction path 2 is formed into a Z-shape as seen from a sheet width direction (the depth direction of the plane of FIG. 2A) orthogonal to the sheet conveyance direction. In Z folding, a downstream part Sd of the sheet S downstream of a first fold F1 in the sheet conveyance direction Dc and an upstream part Su of the sheet S upstream of a second fold F2 face each other in an up-down direction across a middle part Sc of the sheet S between the two folds. In the sheet conveyance direction Dc, the downstream part Sd and the middle part Sc of the sheet S are approximately equal in length, but are shorter than the upstream part Su in length.

Outward triple-folding is a manner of folding in which, as shown in FIG. 2B for example, an entire sheet S is formed into a Z-shape as seen from the sheet width direction (the depth direction of the plane of FIG. 2B). In outward triple-folding, a downstream part Sd of the sheet S downstream of a first fold F1 in the sheet conveyance direction Dc and an upstream part Su of the sheet S upstream of a second fold F2 face each other in the up-down direction across a middle part Sc of the sheet S between the two folds. In the sheet conveyance direction Dc, the downstream part Sd, the middle part Sc, and the upstream part Su of the sheet S are approximately equal in length.

In inward triple-folding, as shown in FIG. 2C for example, an upstream part Su of a sheet S upstream of a first fold F1 in the sheet conveyance direction Dc and a downstream part Sd of the sheet S downstream of a second fold F2 face each other in the up-down direction and make surface contact with each other at one side of (in FIG. 2C, above) the plane of a middle part Sc of the sheet S between the two folds.

In this description, a sheet having been subjected to the folding processing may be referred to as a "folded sheet."

The book-binding portion 114 is disposed in a downstream part of the third sheet discharge path 8 in the sheet conveyance direction, in the vicinity of the third sheet discharge portion 7. The book-binding portion 114 is capable of performing, with respect to a bundle of sheets formed by stacking a plurality of sheets, middle-folding processing and middle-binding processing in which the book-binding portion 114 folds and binds the bundle of sheets substantially at its middle, thereby to form a booklet.

The post-processing control portion 12 includes a CPU, an image processor, a storage, and other electronic circuits and electronic components (of which none is shown). The post-processing control portion 12 is communicably connected to a main control portion of the image forming apparatus (unillustrated). The post-processing control portion 12 receives instructions from the main control portion, and by means of the CPU and based on a control program and control data stored in the storage, controls operations of various components provided in the sheet post-processing device 1 so as to perform processing related to functions of the sheet conveyance device 1. The sheet introduction path 2, the first sheet discharge portion 3, the first sheet discharge path 4, the second sheet discharge portion 5, the second sheet discharge path 6, the third sheet discharge portion 7, the third sheet discharge path 8, and the post-processing portion 11 individually receive instructions from the post-processing control portion 12 to cooperate so as to perform post-processing on sheets. The functions of the post-processing control portion 12 may be assumed by the main control portion of the image forming apparatus.

Figure 3:
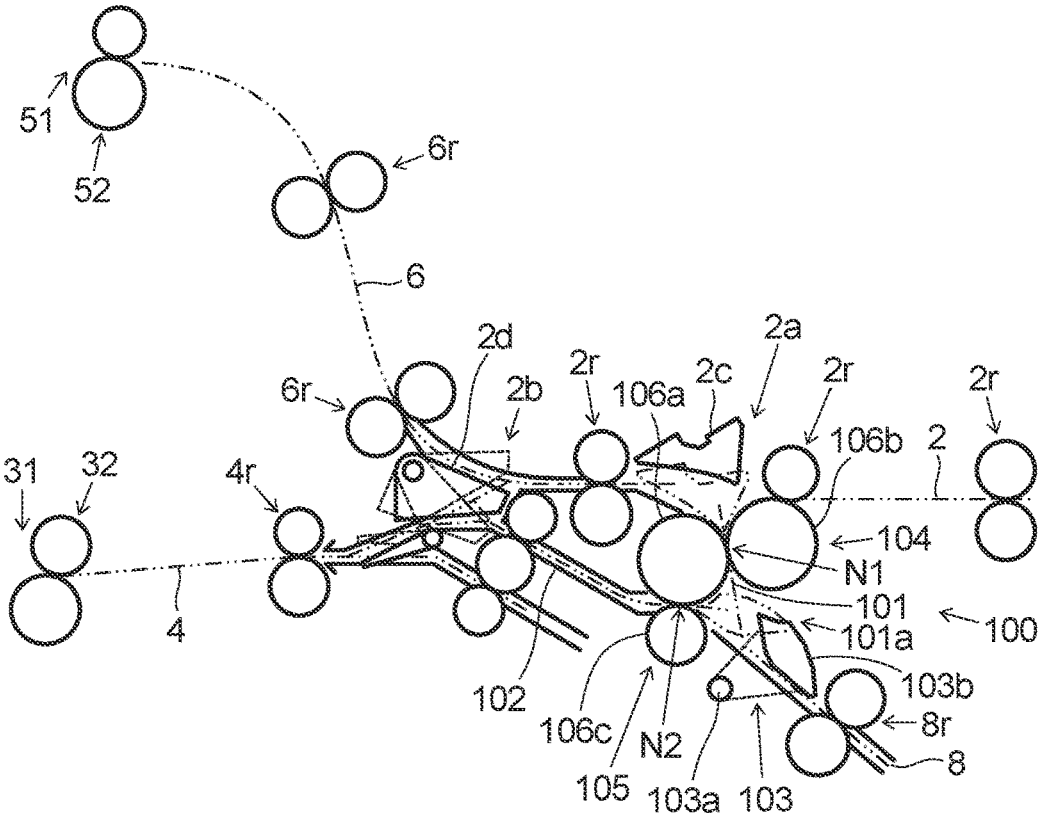
FIG. 3 is a partial sectional front view showing a sheet folding portion of the sheet post-processing device and its vicinity shown in FIG. 1.

Next, a configuration of the sheet folding portion 100 will be described with reference to FIG. 3. FIG. 3 is a partial sectional front view showing the sheet folding portion 100 of the sheet post-processing device 1 and its vicinity shown in FIG. 1. The sheet folding portion 100 includes a first sheet conveyance path 101, a second sheet conveyance path 102, and a folding blade 103.

The first sheet conveyance path 101 is configured as an upstream part of the third sheet discharge path 8 in the sheet conveyance direction. That is, the first sheet conveyance path 101 branches off from the first branching portion 2*a* which is on the sheet introduction path 2, and extends in a direction toward where the third sheet discharge portion 7 is located, in a downward direction in FIG. 3. Along the first sheet conveyance path 101, a sheet is conveyed.

The second sheet conveyance path 102 branches off from a folding branching portion 101*a* which is on the first sheet conveyance path 101, and extends in a direction for intersecting the first sheet conveyance path 101. The second sheet conveyance path 102 extends from the folding branching portion 101*a* toward a side-face-la side part of the sheet post-processing device 1 where the first sheet discharge path 4 is provided, in a leftward direction in FIG. 3. Along the second sheet conveyance path 102, a sheet is conveyed. A downstream end of the second sheet conveyance path 102 in the sheet conveyance direction merges with the second branching portion 2*b*.

The folding blade 103 is disposed in the vicinity of the folding branching portion 101*a* which is on the first sheet conveyance path 101. The folding blade 103 has a swing support shaft 103*a* and a blade portion 103*b*. The swing support shaft 103*a* and the blade portion 103*b* are located, as seen from the sheet width direction (the depth direction of the plane of FIG. 3) orthogonal to the sheet conveyance direction, at positions opposite each other across a sheet conveyance region of the first sheet conveyance path 101, the sheet conveyance region being downstream of the folding branching portion 101*a*.

The swing support shaft 103*a* extends in a direction parallel to the sheet width direction. The folding blade 103 swings about an axis of the swing support shaft 103*a* clockwise or counterclockwise in FIG. 3. Specifically, the folding blade 103 is swingable so as to be disposed at a first position (see FIG. 3) for guiding a sheet conveyed on the first sheet conveyance path 101 to a downstream part of the first sheet conveyance path 101 in the sheet conveyance direction and a second position (see FIG. 6) for guiding a sheet conveyed on the first sheet conveyance path 101 to the second sheet conveyance path 102.

Further, the sheet folding portion 100 includes a pair of first conveyance rollers 104 and a pair of second conveyance rollers 105.

The pair of first conveyance rollers 104 are disposed, with respect to the sheet conveyance direction along the first sheet conveyance path 101, at a downstream part of the first branching portion 2*a*. The pair of first conveyance rollers 104 conveys a sheet on the first sheet conveyance path 101 in a direction away from the first branching portion 2*a*. The pair of first conveyance rollers 104 are constituted of a first roller 106*a* and a second roller 106*b*. The first roller 106*a* and the second roller 106*b* are disposed opposite each other across the sheet conveyance region of the first sheet conveyance path 101, and thereby form a first nip portion N1.

The first switching guide 2*c* is disposed opposite the first nip portion N1 across a sheet conveyance region of the sheet introduction path 2. The first switching guide 2*c* is reciprocatable in directions toward and away from the first nip portion N1.

The first switching guide 2*c* approaches the first nip portion N1 before a sheet conveyed on the sheet introduction path 2 reaches the first branching portion 2*a*, thereby to guide the sheet to the first nip portion N1, thus switching the conveyance direction of the sheet to direct the sheet into the first sheet conveyance path 101 (the third sheet discharge path 8). Further, the first switching guide 2*c* can press such part of a sheet conveyed on the sheet introduction path 2 as has stopped over the first branching portion 2*a* and corresponds to a fold toward the first nip portion N1, and thus can also be used as a folding blade that performs folding processing on the sheet.

The second roller 106*b* is also used as one of the rollers that constitute one of the pairs of feed rollers 2*r* on the sheet introduction path 2.

The pair of second conveyance rollers 105 are disposed in a downstream part of the folding branching portion 101*a* with respect to the sheet conveyance direction along the second sheet conveyance path 102. The pair of second conveyance rollers 105 convey a sheet on the second sheet conveyance path 102 in a direction away from the folding branching portion 101*a*. The pair of second conveyance rollers 105 are constituted of the first roller 106*a* and a third roller 106*c*. The first roller 106*a* and the third roller 106*c* are disposed opposite each other across a sheet conveyance region of the second sheet conveyance path 102, and thereby form a second nip portion N2.

The folding blade 103 is disposed opposite the second nip portion N2 across the sheet conveyance region of the first sheet conveyance path 101. The folding blade 103 is reciprocatable in directions toward and away from the second nip portion N2.

The folding blade 103 approaches the second nip portion N2 before a sheet conveyed on the first sheet conveyance path 101 reaches the folding branching portion 101*a*, thereby to guide the sheet to the second nip portion N2, thus switching the conveyance direction of the sheet to direct the sheet into the second sheet conveyance path 102. The folding blade 103 press such part of a sheet conveyed on the first sheet conveyance path 101 as has stopped over the folding branching portion 101*a* and corresponds to a fold and toward the second nip portion N2, and thereby performs folding processing on the sheet to form a fold therein.

Figure 4:
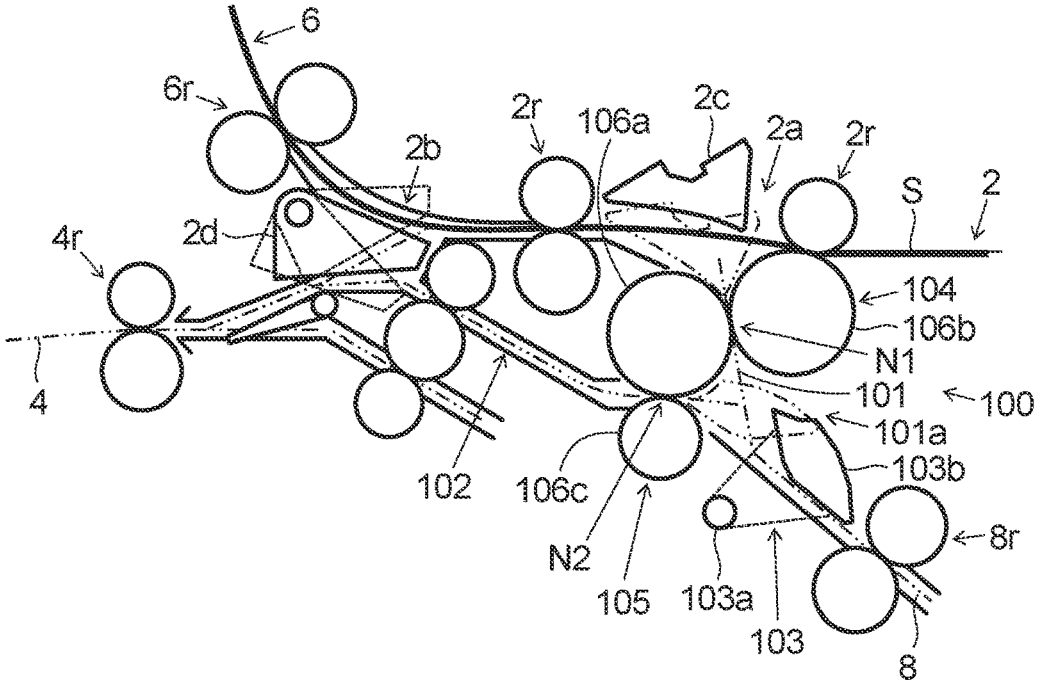
FIG. 4 is a sectional front view showing the sheet folding portion and its vicinity shown in FIG. 3, illustrating a first stage in the course of inward triple-folding processing for a sheet.
Figure 5:
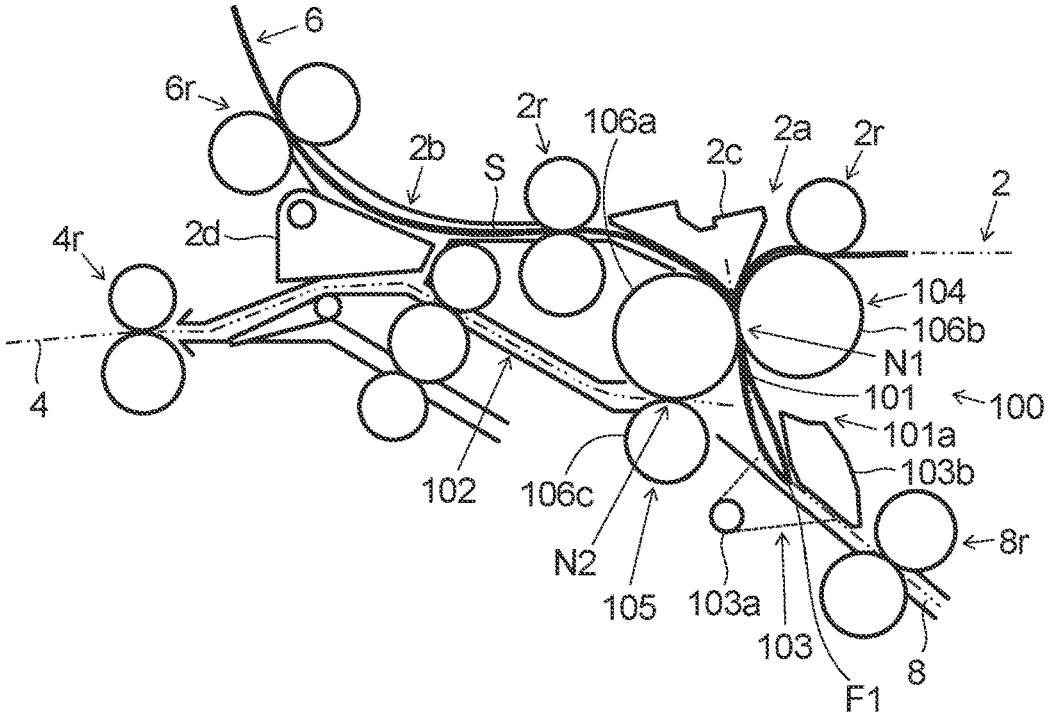
FIG. 5 is a sectional front view showing the sheet folding portion and its vicinity shown in FIG. 3, illustrating a second stage in the course of the inward triple-folding processing for a sheet.
Figure 6:
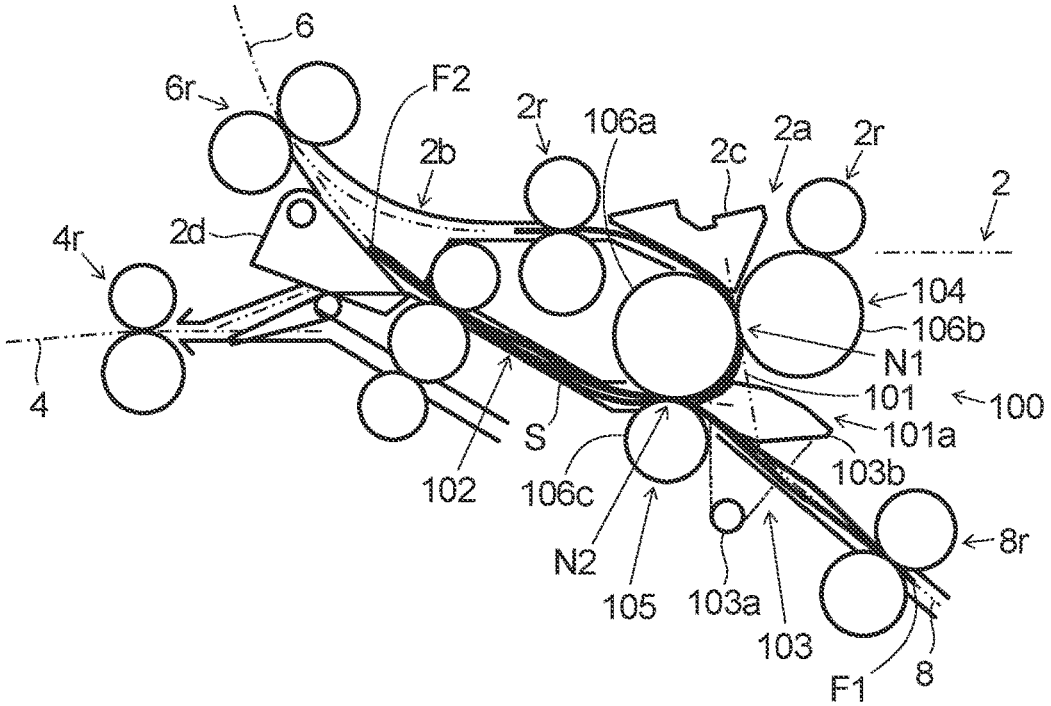
FIG. 6 is a sectional front view showing the sheet folding portion and its vicinity shown in FIG. 3, illustrating a third stage in the course of the inward triple-folding processing for a sheet.

Next, an operation of the sheet folding portion 100 will be described with reference to FIGS. 4, 5, and 6. FIGS. 4, 5, and 6 are sectional front views showing the sheet folding portion 100 and its vicinity shown in FIG. 3, respectively illustrating a first stage, a second stage, and a third stage in the course of inward triple-folding processing for a sheet S. The following description of the operation of the sheet folding portion 100 deals with, as an example, folding processing for inward triple folding as shown in FIG. 2C.

As shown in FIG. 4, when a sheet S is introduced through the sheet introduction port 2*e* (see FIG. 1) into the sheet introduction path 2, a downstream part of the sheet S in the sheet conveyance direction is guided via the second branching portion 2*b* to the second sheet discharge path 6. The second switching guide 2*d* of the second branching portion 2*b* switches the conveyance direction of the sheet S conveyed on the sheet introduction path 2 from the sheet introduction port 2*e* so as to guide the sheet S to the second sheet discharge path 6.

The first switching guide 2*c* of the first branching portion 2*a* is retreated from the sheet introduction path 2 in a direction away from the first nip portion N1, that is, to a position above the sheet introduction path 2 in FIG. 4.

Subsequently, when part of the sheet S corresponding to a first fold F1 (see FIG. 2C) reaches the first branching portion 2*a*, the pairs of feed rollers 2*r* in the sheet introduction path 2 and the pairs of feed rollers 6*r* in the second sheet discharge path 6 are caused to stop rotating, so that the conveyance of the sheet S is stopped. Then, such one of the pairs of feed rollers 2*r* as is disposed, in the sheet introduction path 2, downstream of the first branching portion 2*a* (to the left of the first branching portion 2*a* in FIG. 4) in the sheet conveyance direction and the pairs of the feed rollers 6*r* in the second sheet discharge path 6 are caused to rotate reversely. Thereby, such part of the sheet S as is located downstream of the first branching portion 2*a* in the sheet conveyance direction moves upstream (rightward in FIG. 4), so that the sheet S is caused to sag at the first branching portion 2*a*.

Subsequently, the first switching guide 2*c* is moved in a direction toward the first nip portion N1 of the pair of first conveyance rollers 104, and makes contact with the sheet S. By making contact with the sheet S, the first switching guide 2*c* guides the sagging part of the sheet S to the first nip portion N1. Then, passing through the first nip portion N1, the sheet S has the first fold F1 formed therein as shown in FIG. 5.

The timing for forming the first fold F1 in the sheet S is determined in accordance with the timing with which a sheet sensor (unillustrated) detects, in the first sheet introduction path 2, a downstream end of the sheet S in the sheet conveyance direction, a length of the sheet S in the sheet conveyance direction, and a conveyance speed of the sheet S. This also applies to the timing for forming the second fold F2, which will be described later.

The folding blade 103 at the folding branching portion 101*a* is retreated from the first sheet conveyance path 101 in a direction away from the second nip portion N2, that is, to the right of the first sheet conveyance path 101 in FIG. 5.

After passing through the first nip portion N1, the sheet S is conveyed, starting with its part where the first fold F1 is formed, and with its two regions that extend along the sheet conveyance direction overlapped with each other, along the first sheet conveyance path 101 in a direction away from the first branching portion 2*a*. After passing through the first sheet conveyance path 101, an upstream part of the sheet S in the conveyance direction temporarily enters the third sheet discharge path 8.

Subsequently, when the part of the sheet S corresponding to the second fold F2 (see FIG. 2C) reaches the folding branching portion 101*a*, the pairs of feed rollers 2*r* in the sheet introduction path 2, the pairs of feed rollers 6*r* in the second sheet discharge path 6, the pair of first conveyance rollers 104, and the pairs of feed rollers 8*r* in the third sheet discharge path 8 are caused to stop rotating, so that the conveyance of the sheet S is stopped. Then, the pairs of feed rollers 8*r* in the third sheet discharge path 8 are caused to rotate reversely. As a result, such part of the sheet S as is located downstream of the folding branching portion 101*a* in the sheet conveyance direction (as is below the folding branching portion 101*a* in FIG. 5) moves upstream (upward in FIG. 5), so that the sheet S is caused to sag at the folding branching portion 101*a*.

Subsequently, the folding blade 103 is moved in a direction toward the second nip portion N2 of the pair of second conveyance rollers 105, and makes contact with the sheet S. By making contact with the sheet S, the folding blade 103 guides the sagging part of the sheet S to the second nip portion N2. Then, passing through the second nip portion N2, the sheet S has the second fold F2 formed therein as shown in FIG. 6.

After passing through the second nip portion N2, the sheet S is conveyed, starting with its part where the second fold F2 is formed, and with its three regions that extend along the sheet conveyance direction overlapped with each other, along the second sheet conveyance path 102 in a direction away from the pair of second conveyance rollers 105. After passing through the second sheet conveyance path 102, the sheet S enters the second sheet discharge path 6 via the second branching portion 2*b*, and is guided toward the second sheet discharge portion 5. Meanwhile, at the second branching portion 2*b*, the second switching guide 2*d* switches the conveyance direction of the sheet S having passed through the second sheet conveyance path 102 and reached the second branching portion 2*b* such that the sheet S is guided to the second sheet discharge path 6. The sheet S is guided to the second sheet discharge path 6, to be discharged through the second discharge port 51 onto the second discharge tray 53 (see FIG. 1).

Z-folding processing for Z-folding a sheet S (see FIG. 2A) and in outward triple-folding processing for outward triple-folding a sheet S (see FIG. 2B) can also be performed likewise, by changing the timing for forming the first fold F1 and for forming the second fold F2 in the sheet S, following the procedure described with reference to FIGS. 4, 5, and 6. Further, double-folding processing, quadruple-folding processing, etc. can also be performed likewise on a sheet S by changing the number of times of forming a fold and the timing for forming a fold.

Figure 7:
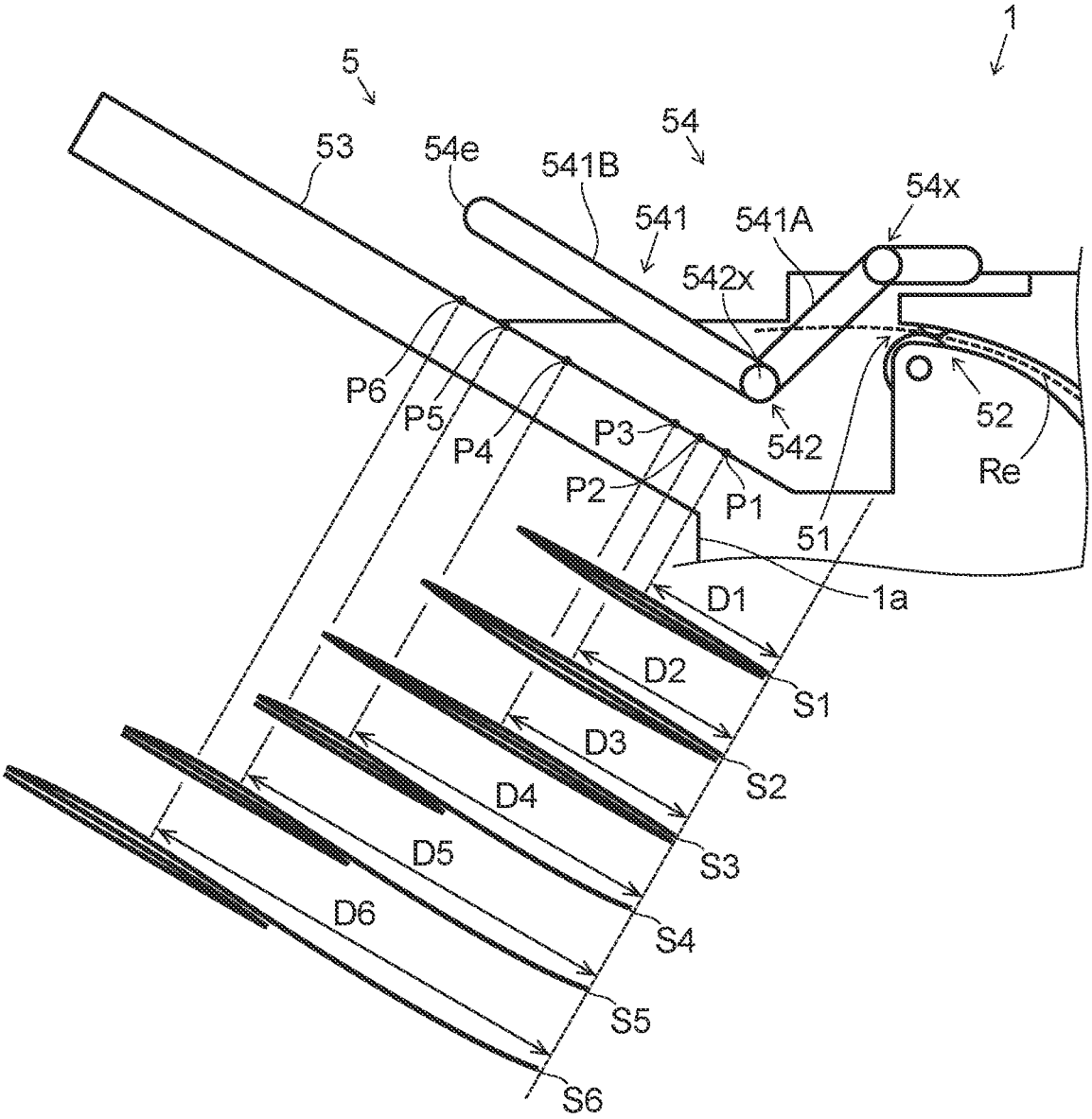
FIG. 7 is a partial sectional front view of and around a second sheet discharge portion of the sheet post-processing device shown in FIG. 1, illustrating a relationship between the second sheet discharge portion and sizes of folded sheets.

Next, a configuration of the second sheet discharge portion 5 and its vicinity will be described with reference to FIG. 7. FIG. 7 is a partial sectional front view of and around the second sheet discharge portion 5 of the sheet post-processing device 1 shown in FIG. 1, illustrating a relationship between the second sheet discharge portion 5 and sizes of folded sheets. The second sheet discharge portion 5 has a sheet holding member 54, in addition to the second discharge port 51, the pair of second discharge rollers 52, and the second discharge tray 53.

The second discharge tray 53 is connected to the side face 1*a* of the sheet post-processing device 1, below the second discharge port 51, and extends downstream in a sheet discharge direction in which a sheet S is discharged through the second discharge port 51. The second discharge tray 53 has an upward inclination toward the downstream side in the sheet discharge direction, that is, away from the side face 1*a* of the sheet post-processing device 1. Thus, a sheet discharged onto the second discharge tray 53 is gravitationally stacked so as to be close to the side of the second discharge port 51, which is on an upstream side in the sheet discharge direction.

The sheet holding member 54 extends parallel to the sheet discharge direction toward the second discharge tray 53, having its one end part (base end part) in its longitudinal direction attached above the pair of second discharge rollers 52 such that the sheet holding member 54 is swingable. Specifically, the sheet holding member 54 is, above the pair of second discharge rollers 52, attached to a housing of the sheet post-processing device 1 via a swing support shaft 54*x* extending in the sheet width direction. The sheet holding member 54, which is swingable about the swing support shaft 54*x*, changes its position by swinging clockwise or counterclockwise in FIG. 7 about the swing support shaft 54*x*.

The other end part (leading end part) of the sheet holding member 54 in its longitudinal direction extends to below the pair of second discharge rollers 52. In the present embodiment, the sheet holding member 54 is disposed at one position in a central part in the sheet width direction. The sheet holding member 54 not only makes contact with a sheet discharged through the second discharge port 51, but also holds a sheet stacked on the second discharge tray 53.

The sheet holding member 54 may be provided as a pair of sheet holding members 54, disposed one at each of opposite sides with respect to a central part of the second discharge tray 53 in the sheet width direction.

The sheet holding member 54 has a plurality of link members 541 and a joint portion 542. In the present embodiment, the sheet holding member 54 has, as the plurality of link members 542, two link members 541A and 541B.

The plurality of link members 541 are each constituted of, for example, a rod member or a spring wire extending parallel to the sheet discharge direction, for example. The plurality of link members 541 are coupled to each other along the sheet discharge direction. For example, the link member 541A and the link member 541B are respectively disposed on an upstream side and on a downstream side in the sheet discharge direction, and they are coupled to each other. The link member 541A has its one end part (base part) in its longitudinal direction attached above the pair of second discharge rollers 52.

The joint portion 542 couples the plurality of link members 541 together. Specifically, the joint portion 542 couples the link member 541A and the link member 541B to each other. The joint portion 542 has a pivot shaft 542*x* extending in the sheet width direction, and is pivotable about the pivot shaft 542*x*.

That is, the two link members 541A and 541B are pivotable about the pivot shaft 542*x*, change their positions relatively by pivoting clockwise or counterclockwise in FIG. 7 about the pivot shaft 542*x*. The sheet holding member 54 is capable of changing its shape by being bent at the joint portion 542 in an up-down direction. Thus, the sheet holding member 54 as a whole is capable of appropriately changing its shape as necessary, and is disposed at the second sheet discharge portion 5.

The changing of the shape of the sheet holding member 54 and the disposing of the sheet holding member 54 near the second discharge tray 53 may be accomplished manually as in the present embodiment, or may be accomplished using, for example, power of a motor or the like.

FIG. 7 schematically depicts folded sheets stacked on the second discharge tray 53. For example, six types of folded sheets S1, S2, S3, S4, S5, and S6 discharged through the second discharge port 51 are stacked on the second discharge tray 53.

The folded sheets S1, S2, and S3 are sheets of A4 size, B4 size, and A3 size, respectively, having been subjected to the inward triple-folding processing (see FIG. 2C). A preferable holding position P1 for the folded sheet S1 is a position that is at a distance D1 (e.g., 50 mm) from an upstream end part of the second discharge tray 53 in the sheet discharge direction. A preferable holding position P2 for the folded sheet S2 is a position that is at a distance D2 (e.g., 60 mm) from the upstream end part of the second discharge tray 53 in the sheet discharge direction. A preferable holding position P3 for the folded sheet S3 is a position that is at a distance D3 (e.g., 70 mm) from the upstream end part of the second discharge tray 53 in the sheet discharge direction.

The folded sheets S4, S5, and S6 are sheets of A4 size, B4 size, and A3 size, respectively, having been subjected to the Z-folding processing (see FIG. 2A). A preferable holding position P4 for the folded sheet S4 is a position that is at a distance D4 (e.g., 112 mm) from the upstream end part of the second discharge tray 53 in the sheet discharge direction. A preferable holding position P5 for the folded sheet S5 is a position that is at a distance D5 (e.g., 137 mm) from the upstream end part of the second discharge tray 53 in the sheet discharge direction. A preferable holding position P6 for the folded sheet S6 is a position that is at a distance D6 (e.g., 156 mm) from the upstream end part of the second discharge tray 53 in the sheet discharge direction.

In order to hold the sheets at the positions P1, P2, P3, P4, P5, and P6, the sheet holding member 54 is swingable about the swing support shaft 54*x*, and further, the two link members 541A and 541B are pivotable about the pivot shaft 542*x* so as to change the shape of the sheet holding member 54. According to the above-described configuration, the sheet holding member 54 can be disposed above the second discharge tray 53 with its shape appropriately changed as necessary so as to fit undulating surfaces of sheets discharged onto the second discharge tray 53. Thus, regardless of types of sheets, it is possible to stack a large number of sheets on the second discharge tray 53 in an aligned manner.

That is, for example, in a case where a fullness detection sensor (unillustrated) is used to detect an amount of sheets stacked on the second discharge tray 53, it is possible to avoid erroneous detection of fullness when the amount of stacked sheets is smaller than a specified amount. According to the above-described configuration, regarding the amount of sheets stacked on the second discharge tray 53, it is possible to achieve more accurate fullness detection.

Being disposed in the central part in the sheet width direction, the sheet holding member 54 by itself can hold the sheets stacked on the second discharge tray 53. That is, it is possible, with a simple and low-cost configuration, to stack a large number of sheets on the second discharge tray 53 in an aligned manner.

Figure 8:
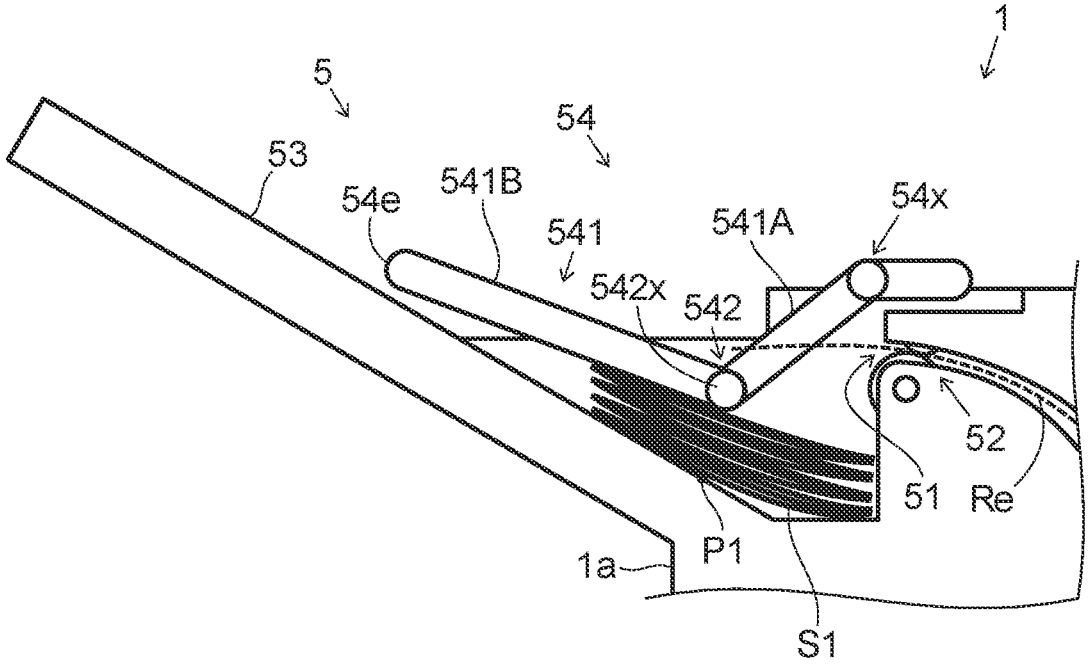
FIG. 8 is a partial sectional front view showing the second sheet discharge portion and its vicinity shown in FIG. 7, illustrating a discharged state of inward triple-folded sheets.

FIG. 8 is a partial sectional front view showing the second sheet discharge portion 5 and its vicinity shown in FIG. 7, illustrating a discharged state of inward triple-folded sheets S1. As shown in FIG. 8, the sheet holding member 54, at a position downstream of the pair of second discharge rollers 52 in the sheet discharge direction, intersects a discharge route Re for folded sheets, and extends downward from above the pair of second discharge rollers 52, toward the second discharge tray 53. Furthermore, the sheet holding member 54 is bent into a V-shape, with the joint portion 542 disposed at the coupling portion between the two adjacent link members 541A and 541B as the vertex of the V-shape, so as to extend over the second discharge tray 53 downstream in the sheet discharge direction.

The joint portion 542 of the sheet holding member 54 is located at a lowest part of the sheet holding member 54, over an upstream part of the second discharge tray 53 in the sheet discharge direction. The joint portion 542 is located near the preferable holding position P1 for the folded sheet S1 described above with reference to FIG. 7.

The inward triple-folded sheets S1 are short in length in the sheet discharge direction, so that they do not make contact with a downstream part of the link member 541B. As a result, when the number of folded sheets S1 stacked on the second discharge tray 53 increases, the link member 541B inclines so that a downstream end part 54*e* thereof in the sheet discharge direction is near the second discharge tray 53.

As in the above-described configuration, the joint portion 542 of the sheet holding member 54 makes contact with the folded sheet S1, which is a folded sheet of the smallest size stacked on the second discharge tray 53. According to this configuration, the sheet holding member 54 can hold, at the joint portion 542, the sheet S1, which is a folded sheet of the smallest size stacked on the second discharge tray 53. Furthermore, sheets of sizes larger than the folded sheet S1, which is of the smallest size, can be held by the link member 541B, which is coupled to the joint portion 542 on the downstream side thereof in the sheet discharge direction. Thus, regardless of sizes of sheets, a large number of sheets can be stacked on the second discharge tray 53 in an aligned manner.

Figure 9:
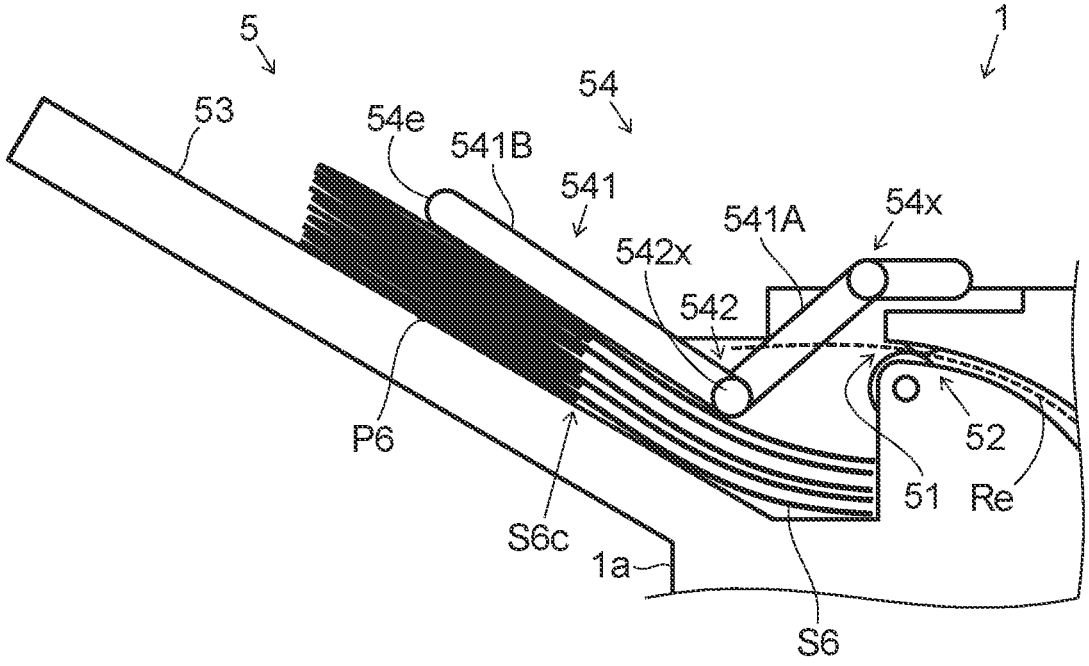
FIG. 9 is a partial sectional front view showing the second sheet discharge portion and its vicinity shown in FIG. 7, illustrating a discharged state of Z-folded sheets.

FIG. 9 is a partial sectional front view showing the second sheet discharge portion 5 and its vicinity shown in FIG. 7, illustrating a discharged state of Z-folded sheets S6. As shown in FIG. 9, the sheet holding member 54, at a position downstream of the pair of second discharge rollers 52 in the sheet discharge direction, intersects the discharge route Re for folded sheets, and extends downward from above the pair of second discharge rollers 52, toward the second discharge tray 53. Furthermore, the sheet holding member 54 is bent into a V-shape, with the joint portion 542 disposed at the coupling portion between the two adjacent link members 541A and 541B as the vertex of the V-shape, so as to extend over the second discharge tray 53 downstream in the sheet discharge direction.

The joint portion 542 of the sheet holding member 54 is located at a lowest part of the sheet holding member 54, over an upstream part of the second discharge tray 53 in the sheet discharge direction. The downstream part of the link member 541B in the sheet discharge direction is located above the preferable holding position P6 for the folded sheet S6 described above referring to FIG. 7. Specifically, the downstream end part 54*e* of the link member 541B in the sheet discharge direction is located downstream of a central part S6*c* of the folded sheets S6.

Folded parts of the Z-folded sheets S6 are located downstream of the joint portion 542 in the sheet discharge direction. As a result, when the number of folded sheets S6 stacked on the second discharge tray 53 increases, the link member 541B inclines so that a downstream end part 54*e* thereof in the sheet discharge direction is away from the second discharge tray 53.

As in the above-described configuration, with respect to the sheet discharge direction, the downstream end part 54*e* of the sheet holding member 54 is located downstream of the central part S6*c* of the folded sheet S6, which is a folded sheet of the largest size stacked on the second discharge tray 53. According to this configuration, the sheet holding member 54 can hold, by means of the link member 541B, a downstream part of the folded sheet S6 in the sheet discharge direction, the folded sheet S6 being a sheet of the largest size stacked on the second discharge tray 53. Furthermore, sheets of sizes smaller than the folded sheet S6, which is of the largest size, can also be held by the link member 541B. Thus, regardless of sizes of sheets, a large number of sheets can be stacked on the second discharge tray 53 in an aligned manner.

Figure 10:
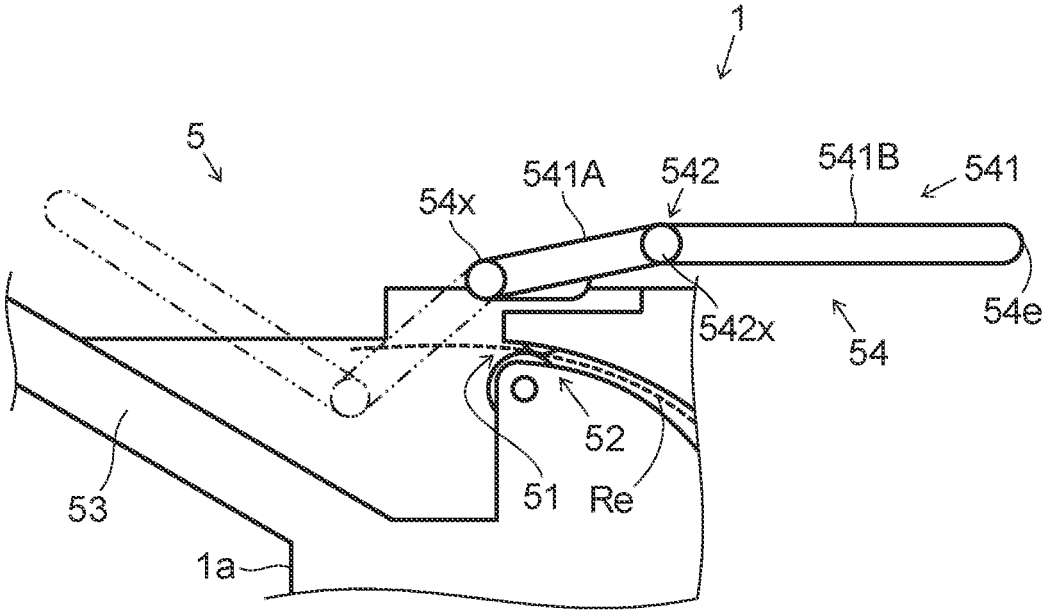
FIG. 10 is a partial sectional front view showing the second sheet discharge portion and its vicinity shown in FIG. 7, illustrating a retreated state of a sheet holding member.

FIG. 10 is a partial sectional front view showing the second sheet discharge portion 5 and its vicinity shown in FIG. 7, illustrating a retreated state of the sheet holding member 54. As shown in FIG. 10, in the sheet holding member 54, the position of the link member 541A can be changed by rotating it upward, clockwise in FIG. 10, about the swing support shaft 54*x* disposed at the fitting position of the link member 541A above the pair of second discharge rollers 52. The link member 541B of the sheet holding member 54 is located upstream (to the right in FIG. 10) of the link member 541A in the sheet discharge direction.

In other words, the sheet holding member 54 can be retreated to a position above the discharge route Re for folded sheets. According to this configuration, in a case where, for example, a sheet with low solidity (rigidity, stiffness) is discharged through the second discharge port 51, the sheet holding member 54 can be disposed at the retreat position. This makes it possible, regardless of the types of sheets, to stack a large number of sheets on the second discharge tray 53 in an aligned manner.

Next, modified examples of the sheet conveyance device 1 will be described.

Figure 11:
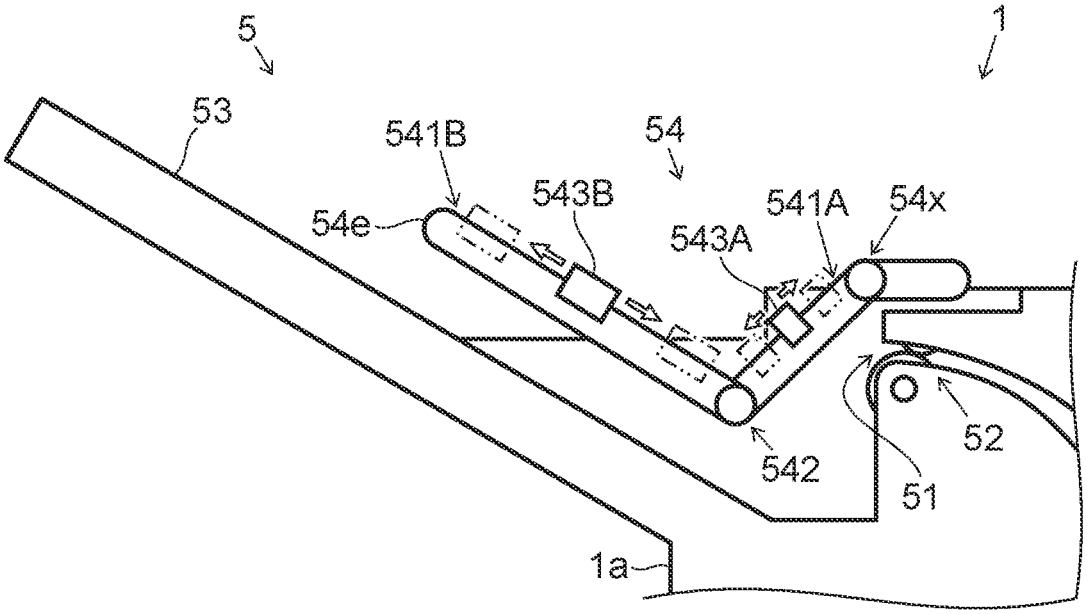
FIG. 11 is a partial sectional front view showing a second sheet discharge portion of a sheet post-processing device and its vicinity according to a first modified example.

FIG. 11 is a partial sectional front view showing a second sheet discharge portion 5 and its vicinity of a sheet post-processing device 1 according to a first modified example. The sheet holding member 54 of the first modified example has weight members 543A and 543B. In the present embodiment, the sheet holding member 54 has the two weight members 543A and 543B, but it may have at least one weight member.

The weight members 543A and 543B are individually attached to the link members 541A and 541B, respectively. The weight members 543A and 543B each have a predetermined weight. The weight members 543A and 543B are movable in longitudinal directions of the link members 541A and 541B, respectively. In other words, the weight members 543A and 543B are movable along the discharge direction of a sheet.

For example, in a case where a thin sheet is discharged through the second discharge port 51, the weight members 543A and 543B are preferably moved to an upstream side in the discharge direction of the sheet, that is, in a direction toward the second discharge port 51. For example, in a case where a thick sheet is discharged through the second discharge port 51, the weight members 543A and 543B are preferably moved to a downstream side in the discharge direction of the sheet, that is, in a direction away from second discharge port 51.

Sheets of different weights, for example, require different amounts of load for them to be held. According to the configuration of the first modified example, in accordance with the type of a sheet, it is possible to appropriately adjust, as necessary, the amount and the position of load to be applied to the sheet from the sheet holding member 54. This makes it possible to preferably hold sheets stacked on the second discharge tray 53 with the sheet holding member 54. Thus, it is possible to stack a large number of sheets on the second discharge tray 53 in an aligned manner.

For example, based on the size of sheets in the discharge direction and the number of the sheets stacked on the second discharge tray 53, the weight members 543A and 543B are disposed at positions in the discharge direction of the sheets. According to this configuration, it is possible, based on the size of sheets in the discharge direction and the number of the sheets stacked on the second discharge tray 53, to preferably determine the amount and the position of load to be applied from the sheet holding member 54 to the sheets.

Figure 12:
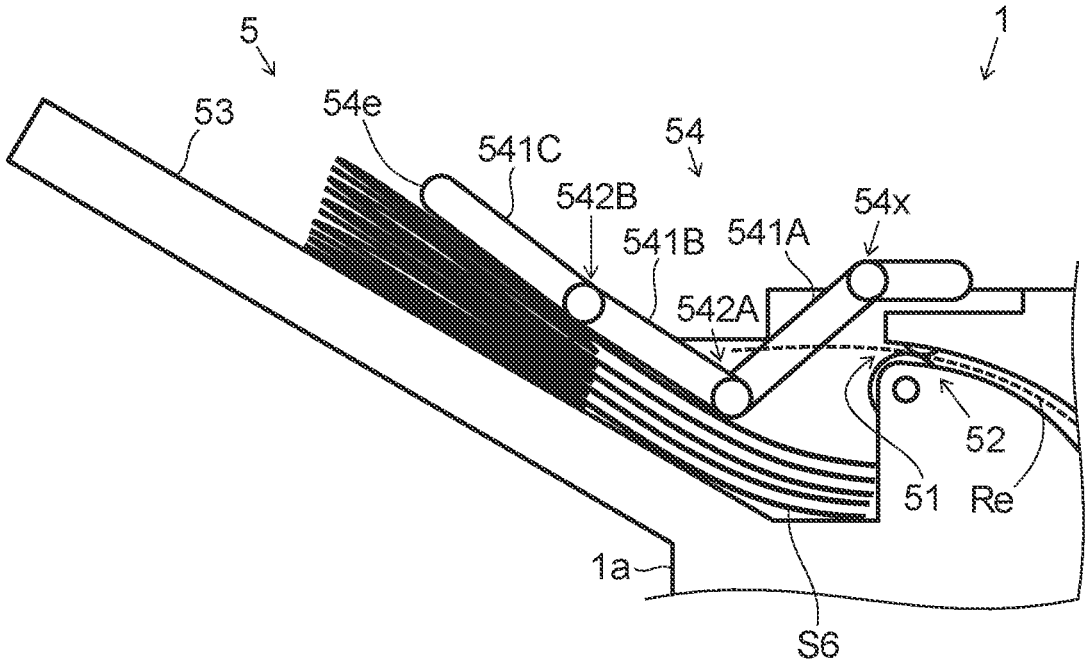
FIG. 12 is a partial sectional front view showing a second sheet discharge portion of a sheet post-processing device and its vicinity according to a second modified example.

FIG. 12 is a partial sectional front view showing a second sheet discharge portion 5 and its vicinity of a sheet post-processing device 1 according to a second modified example. The sheet holding member 54 of the second modified example has three link members 541A, 541B, and 541C as the plurality of link members 541, and has two joint portions 542A and 542B as the joint portion 542.

That is, the link member 541 may include three or more link members 541. That is, the joint portion 542 may include two or more joint portions 542. According to this configuration, it is possible to effectively change the shape of the sheet holding member 54 as necessary so as to fit the undulating surface of a sheet discharged onto the second discharge tray 53. This makes it possible, regardless of the types of sheets, to stack a large number of sheets on the second discharge tray 53 in an aligned manner. Here, the weight member 543 described in the first modified example may be attached to each of the link members 541.

The above-described embodiments are by no means meant to limit the scope of the present disclosure, and various modifications can be made and implemented within the scope not departing from the gist of the present disclosure.

What is claimed is:

1. A sheet post-processing device, comprising:

a discharge port having a pair of discharge rollers that discharge a sheet including a folded sheet subjected to folding processing;

a discharge tray on which the sheet discharged through the discharge port is stacked; and a sheet holding member that is swingably attached above the pair of discharge rollers to extend toward the discharge tray, and that holds the sheet stacked on the discharge tray, wherein the sheet holding member has a plurality of link members coupled to each other along a discharge direction of the sheet, and a joint portion that couples the plurality of link members to each other, the sheet holding member is capable of changing a shape thereof by being bent at the joint portion in an up-down direction, the sheet holding member has a weight member attached to at least one of the link members, and the weight member is movable along the discharge direction of the sheet.

2. The sheet post-processing device according to claim 1, wherein the weight member is, based on a size of the sheet in the discharge direction of the sheet and a number of the sheet stacked on the discharge tray, disposed at a predetermined position in the discharge direction of the sheet.

* * * * *